US006321965B1

(12) United States Patent
Lavi et al.

(10) Patent No.: US 6,321,965 B1
(45) Date of Patent: Nov. 27, 2001

(54) ENHANCED DISPENSING SYSTEM FOR LUGGAGE TAGGING

(75) Inventors: Gavriel Lavi, Valencia, CA (US); Edwin Chan, Brooklyn, NY (US); Clay A. Burns; Timothy J. Kennedy, both of New York, NY (US); Thomas Dair, Yorktown Heights, NY (US)

(73) Assignee: Lavi Industries, Brewster, NY (US)

( * ) Notice: Subject to any disclaimer, the term of this patent is extended or adjusted under 35 U.S.C. 154(b) by 0 days.

(21) Appl. No.: 09/304,795

(22) Filed: May 4, 1999

(51) Int. Cl.[7] ..... B26F 3/02; B65H 35/10

(52) U.S. Cl. ..... 225/106; 225/32; 225/39; 221/197

(58) Field of Search ..... 283/105, 103, 283/903, 51; 221/70, 71, 197; 25/32, 94, 7, 52, 106, 13, 39

(56) References Cited

U.S. PATENT DOCUMENTS

| | | | | |
|---|---|---|---|---|
| D. 343,690 | | 1/1994 | Carey . | |
| 1,039,167 | * | 9/1912 | Meier et al. | 283/105 |
| 2,309,398 | * | 1/1943 | Keller | 283/105 |
| 3,261,522 | * | 7/1966 | Auer et al. | 225/94 |
| 3,589,066 | * | 6/1971 | Fisher | 49/35 |
| 3,885,724 | * | 5/1975 | Ehrlund | 225/39 |
| 3,917,276 | * | 11/1975 | Green Barg | 283/903 |
| 4,121,004 | | 10/1978 | Ehrlund . | |
| 4,180,284 | | 12/1979 | Ashley . | |
| 4,264,403 | | 4/1981 | Emmel et al. . | |
| 4,364,501 | * | 12/1982 | Curtiss, Jr. | 225/13 |
| 4,737,393 | | 4/1988 | Linkous . | |
| 4,811,545 | * | 3/1989 | Oxman | 225/52 |
| 4,858,806 | | 8/1989 | Schafer . | |
| 5,100,038 | * | 3/1992 | Schafer | 225/32 |
| 5,263,621 | | 11/1993 | Bedi . | |
| 5,294,034 | | 3/1994 | Svensson . | |
| 5,695,107 | | 12/1997 | Shoemaker, Jr. . | |
| 5,755,369 | * | 5/1998 | Holmes | 225/52 |
| 5,810,200 | * | 9/1998 | Trokhan | 225/106 |
| 5,868,277 | | 2/1999 | Schafer . | |

FOREIGN PATENT DOCUMENTS

| | | |
|---|---|---|
| 3605351 | 9/1987 | (DE) . |
| 0325515 | 7/1989 | (EP) . |
| 0347181 | 12/1989 | (EP) . |

* cited by examiner

*Primary Examiner*—Kenneth E. Peterson
*Assistant Examiner*—Stephen Choi
(74) *Attorney, Agent, or Firm*—Pillsbury Winthrop LLP

(57) ABSTRACT

A novel system for dispensing tickets wherein a continuous strip is individuated into separate units by the force of users pulling each individual luggage tag through an aperture located at one end of a dispensing mechanism having a detent mechanism for shearing pre-scored and pre-arranged tickets that is used in combination with an interference and/or ramped spacing mechanism. The same may be mounted in a stanchion, on any existing environmental structure, or in a counter, and may include rectangular, rolled and alternatively shaped housing. Particularly useful for luggage tagging applications, a self-engaging ticket-like article may be used with existing guidance systems and an optional writing surface to allow users to procure and apply identifying indicia to such articles for marking luggage on an expedited basis while traveling.

7 Claims, 15 Drawing Sheets

ENHANCED DISPENSING SYSTEM FOR LUGGAGE TAGGING

BACKGROUND OF THE INVENTION

The present invention relates devices for dispensing tickets. In particular the present invention relates to novel apparatus for dispensing individual strips which may, for example, be attached to articles to identify them, and may be located in desired settings, for housing and selectively releasing unique, pre-arranged stacked and scored articles which are especially suited for use as, for example, tagging devices for luggage, inter alia. No limitations of applications of the teachings of the present invention are implied by the descriptions of operation of preferred embodiments offered hereafter, which are merely illustrative.

AREA OF THE ART

Although the increased population and diminishing resource base is an issue most urban people are compelled to deal with daily, little improvement in methods for creating lines, or ordering those within them has been noted. Likewise, even as ticket-like articles must be dispensed everywhere from the Post Office to stadium-based sporting events, the technology continues to lag behind the ever-increasing need for aids for 'queuing-up.'

Conventional ticket dispensers have never assumed a prominent role in luggage tagging because they are not convenient, efficient, or safe enough to function in the high traffic areas addressed by the teachings of the present invention. The same principles apply to related fields, as explained below.

By way of example, most travelers who frequent airports, sea-ports or train stations are all too familiar with the pitfalls of known luggage tagging methods. Owing to time constraints, those who need to create tags which identify themselves as owners of articles of luggage, often including address information penned on an expedited basis, have been subject to several longstanding problems until the advent of the instant teachings.

Prominent among these difficulties are the general availability of tagging articles to personalize and attach. Similarly lacking are convenience and placement of writing surfaces or analogous areas to help travelers to personalize their baggage with luggage tags. This lack of existing mechanisms to assist users to personalize tags and locate tags is exacerbated when harried travelers are forced to stand in line with limited time available for searching for such tags. As discussed below, solutions to each of these previously unsolved problems are addressed by the teachings of the present invention, as are numerous others in related fields of endeavor, by analogy from the instant examples.

Use of previously prepared luggage tags is constrained by a high loss rate for such articles. Likewise, in terms of aesthetics—or individual preferences for appearance—it is often desirable to have the clutter of such tags eliminated as soon as they are no longer needed. Similarly, the numerous articles and containers which accompany todays' travelers cannot be tagged until they are ready to travel, creating a strong need for an on-site source of readily attachable luggage tags.

Those needing to queue up, at the box office, for example, would be well served by a mechanism that was readily suited to, or perhaps previously existing in, the place where the line had to be formed. For this reason, as well as for the reasons developed more fully below, the existence of applicant's/ assignee's own BELTRAC® public guidance system, along with its specialized stanchions, is strong evidence of the industrial efficacy of the instant teachings.

Likewise, according to a preferred embodiment discussed in detail below, the unique nature of the present invention which, among other things, combines a commercially successfull BELTRAC® public guidance system, having grooved and linked stanchions with a novel enhanced dispensing system for ticket-like articles, clearly addresses and overcomes the longstanding needs described above.

Similarly, applicants' alternate preferred embodiments, dual detent mechanisms, unique overlapping scores and incisions system for ticket-like articles, and rectangular or roller housing format contribute a host of heretofore undisclosed ways to address the problems which are outlined above.

DESCRIPTION OF THE PRIOR ART

Known apparatus, methods and systems lack the reliability, simple elegance and durability of the present invention as defined by the claims offered for consideration hereafter. A perusal of either of the two separate lines of prior art patents available urges strongly for the solutions employed according to the teachings of the present invention.

For example, among U.S. Pat. No. 5,294,034 issued Mar. 15, 1994 to Svensson, and assigned to TURN-O-MATIC AB of Sweden, shows the typical arrangement employed with known dispensing systems with a cumbersome casing and complex guiding mechanism for its feed path. The Svesnsson patent requires a pair of mutually opposed guide surfaces to track the strip of connected tickets through a convoluted series of bends and turns, which differentiates this disclosure from the teachings of the present invention.

Likewise, U.S. Pat. No. 5,695,107 issued Dec. 9, 1997 to Shoemaker, Jr. discloses an extremely elaborate set of drive rollers, pinch rollers and tension springs designed to move a strip of tickets along a feed path. This invention further requires the use of a removable central dividing portion to separate its strip into individual ticket pieces, which by itself distinguishes it from the teachings of the present invention. It is noteworthy that this disclosure highlights an additional aspect of the problems solved by the present invention, namely, how to create a continuous strip of connected ticket-like articles that can be readily separated to form individuated units.

The reliability and durability of the mechanically complex structures required by the prior art in general, and for these two patents in specific, differentiates both of these references, and the two respective lines of patents which they represent, from the teachings of the present invention. Accordingly, further discussion of these types of patents is omitted at this time because they merely serve to demonstrate the longstanding need for a compact, reliable and simply elegant solution to the longstanding problem of providing facile and effective on-site dispensing systems for ticket-like articles.

Likewise, attention is called to assignee Lavi Industries' (Valencia, Calif.) U.S. Pat. No. Des. 343,690 for a Crowd Control Belt Post, or Stanchion, which design, as mentioned above, has achieved considerable commercial success, as marketed under the trademark BELTRAC®, and found in most major airports. One aspect of the present invention combines a unique dispensing system with the patented article for the purpose of dispensing luggage tags to users at desired locations in a reliable manner. Having designed, installed, modified, and made safe such stanchions for airport use, combining the same with the below disclosed cartridge system to achieve the objects of the present invention has enabled the present inventors to implement the claims appended hereto, in one embodiment.

The ticket-like articles themselves constitute yet another unrequited need addressed by the instant teachings. Although known configurations for such types of luggage tags enable a user to insert a first end of a single piece article through a key-shaped hole located at a second end to form a tag, the tags themselves pose further challenges to harried travelers. For example, storing previously separated tagging articles requires constant monitoring and upkeep by third parties. Known baskets of such articles seem to become inconveniently emptied, and are subject to related problems. While existing tag configurations allow a folded resulting product to be rapidly attached to luggage, no prior art patents have been uncovered which provide a way to offer a continuous strip of such articles that could be made available to a user in, for example, an airport.

Either within or without a stanchion, the instant teachings provide a straight forward alternative to existing systems for the storage and dispensing of tickets. Likewise, according to at least three separate preferred embodiments, the present invention addresses the longstanding need for improved ticket dispensing systems. In particular, the instant teachings have proven themselves to be quite effective within the context of providing readily accessible tags for luggage, solving the strong requirement for the same which is evinced by the numerous drawbacks of conventional disclosures in this field.

SUMMARY OF THE INVENTION

Accordingly, among the objects of the present invention is provision of a simply elegant, durable and reliable mechanism for dispensing uniquely re-designed and known ticket-like articles.

An additional object of the present invention is to provide a novel enhanced system to dispense tickets, including a self-contained cartridge particularly useful for the storage of, and dispensing of, individuated ticket-like articles.

A further object of the present invention is the provision of a stanchion-based, or otherwise attached, placed or located, ticket dispensing system, which may be joined to either fixed environmental structure or other similar stanchion type linked devices to form a barrier, which system of linked BELTRAC® devices are effective for being located in places where forming of lines is important.

Yet a still further object of the present invention is to provide a continuous strip of pre-arranged, ticket-like, self-engaging tagging articles having predetermined perforations and capable of being stored, stacked and dispensed with a folded orientation facilitating their orderly and efficient release by a self-contained dispensing mechanism.

Briefly stated, there is provided a novel system for dispensing tickets wherein a continuous strip is individuated into separate units by the force of a users' pulling each individual luggage tag through an aperture located at one end of a dispensing mechanism having a manual or mechanically biased detent means for shearing pre-scored and pre-arranged tickets. At least three embodiments allow for the same being mounted in a stanchion, on any existing environmental structure, or in a counter. Particularly useful for luggage tagging applications, a self-engaging ticket-like article may be used with existing BELTRAC® guidance systems and an optional writing surface to allow users to procure and apply identifying indicia to such articles for marking luggage on an expedited basis while traveling.

According to an embodiment of the present invention, there is provided a dispensing system for luggage tags, comprising; a stanchion having a top and a bottom,cartridge disposed in said stanchion, dispensing means adjacent the top of said stanchion, a plurality of luggage tags housed in said cartridge, and means, joined to said stanchion, for selectively engaging each of said plurality of luggage tags, in conjunction with said dispensing means.

According to another feature of the present invention, there is provided a ticket dispensing system, comprising, in combination; a stanchion for housing a cartridge member, a cartridge member for storing, dispensing, and managing the level of a multiplicity of pre-arranged tickets, a means for reloading the cartridge member housed within said stanchion and a means for applying identifying indicia to each of said multiplicity of pre-arranged tickets.

According to another feature of the present invention, there is provided a method for dispensing individual ticket articles useful for luggage tagging, comprising the steps of: providing a stanchion having a first and a second end housing a cartridge member for storing, dispensing, and managing the level of a strip further comprising a multiplicity of pre-arranged tickets with pre-scored perforations, directing said strip in a ticket path through said cartridge from a distal end to a proximate end through a ramped spacing mechanism providing room for said strip to turn while being directed, selectively gripping an individual ticket article with an internal detent mechanism comprising a spring loaded piston, guiding said strip through a slotted aperture and releasing an individual ticket article by breaking said strip at the pre-creased, pre-scored perforation.

According to an additional feature of the present invention, there is provided a cartridge for housing a plurality of creased and pre-scored individual luggage tags attached in a continuous strip, comprising: a box having proximate and distal ends, divided into at least a divisible-chamber having a ramped spacing mechanism for providing adequate space to allow turning of the continuous strip as it moves from the distal end to the proximate end, an internal detent means for serially gripping a key-hole like aperture located a in a central portion of each individual luggage tag and a dispensing aperture, located at said proximate end, whereby a user views an exposed portion for grippingly engaging the individual luggage tag and releasing the individual luggage tag from said internal detent means.

According to another additional feature of the present invention, there is provided a strip of self-engaging tickets comprising, a contiguous strip of flat luggage tagging devices, each individual unit being defined by two lines of overlapping scores furthering defining scored, perforated borders, and, a key-hole like aperture disposed at a central portion thereof closer to one of said borders.

According to another feature of the present invention, a pre-determined number of luggage tags at the end of the strip of tags may be color-coded or otherwise labeled to identify the end of the strip.

According to yet still another additional feature of the present invention there is provided a ticket dispensing system, which comprises, in combination; a cartridge member for storing, dispensing, and managing the level of a multiplicity of pre-creased tickets having at least one detent means selected from the group consisting of complete interference and a ramped spacing mechanism, in combination with a mechanically biased member for selectively releasing each of said multiplicity of pre-arranged tickets; and means for reloading the cartridge.

The above, and other objects, features and advantages of the present invention will become apparent from the following description read in conjunction with the accompanying drawings in which like reference numerals designate the same elements.

DESCRIPTION OF THE FIGURES

The file of this application contains at least one drawing executed in color. Copies of this patent with color drawings will be provided by the Patent and Trademark Office upon request and payment of the necessary fee.

The above-mentioned and other features of this invention and the manner of obtaining them will become more apparent, taken in conjunction with the accompanying drawings. These drawings depict only typical embodiments of the invention and do not therefore limit its scope. They serve to add specificity and detail, in which.

DETAILED DESCRIPTION OF THE INVENTION

Figure 1:
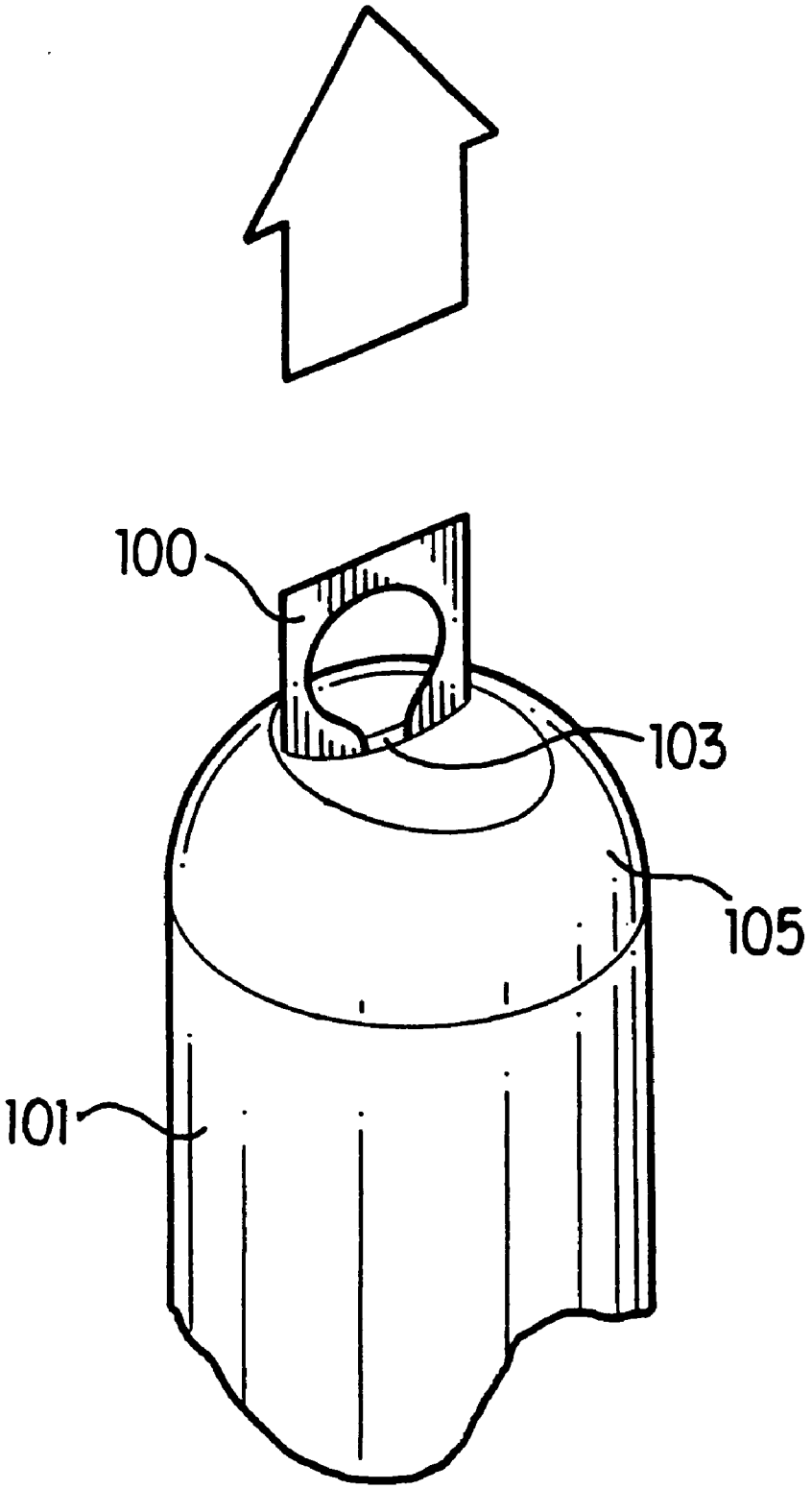
FIG. 1 is a first of three views of a ticket dispensing sequence, showing a tag which is ready for use, according to an embodiment of the present invention.

The present assignee has been involved in the field of crowd control, assisting those charged with handling high volumes of human traffic, for at least the last decade. In addressing the issues which have plagued this field of endeavor, innovations have not been forthcoming as quickly as additional constraints.

For example, today's stadium visitor is often forced to fight her way through box-office, entrance, food, bathroom and souvenir lines before even taking her seat. Likewise, most public forum involve some manner of queuing up, which are amenable to the addition mechanisms to create higher degrees of order.

Having experienced the commercial success of the BELTRAC® type of public guidance column system of linked stanchions (Lavi Industries, Valencia, Calif.), the present assignee has now, in one form, embodied the objects of the present invention in several different forms, each of which is believed to constitute an advancement in the progress of science and the useful art. In one embodiment according to the present invention, the conceptual underpinnings may be related both to the aforementioned BELTRAC® system and the idea of an "Estiquet", (from the old French meaning "marker where tickets are taken" or "ticket stanchion") or "stanchion" housing luggage marking tags or "tickets," as combined in the present invention to define a unique system for enabling a user to tag his luggage, while marking the place where one can get such items. As discussed above, the uniqueness of this approach addresses at least several prominent needs highlighted by the dirth of such devices among the prior art.

However, this embodiment is likewise accompanied by at least the other three alternate preferred embodiments discussed herein. Namely, as detailed below embodiments of the present invention are manifested in a form independent of the above-discussed stanchions, in a roll dispenser form, and also as a gravity fed dispenser. Each of these embodiments demonstrates the utility of the instant teachings within a plurality of alternate contexts and settings.

In sum, the present inventor has discovered that a novel, enhanced dispensing system for ticket-like articles which may be used in many different settings. Although the embodiment discussed at length below is for use with articles for luggage tagging, each of applicant's alternate preferred embodiments also addresses and solves numerous longstanding issues in this field of art.

For ease of reference, as discussed in this application, the terms "ticket" and "tag" are used in a definitionally interchangeable sense, and defined by reference to above illustrated individuated units which form a continuous strip and are removed by a user from the novel dispensing means of the present invention. It is readily understood that those skilled in the ticketing arts are capable of generating variations of these illustrative embodiments, which are not intended to be limiting of the teachings of the present invention as described hereafter.

Referring now to FIG. 1, a first end of continuous ticket strip 100 is shown extending from a top portion of stanchion 101 through slotted aperture 103 of cover 105.

A direction of travel is schematically illustrated by the arrow, which likewise indicates the direction that a user pulls a proximate end of continuous ticket strip 100 to remove a portion of it from an illustrated portion of stanchion 101 through slotted aperture 103 of cover 105. Likewise, this operational sequence is understood to apply wherein stanchion 101 has been replaced by a countertop, or the like fixed or mobile environmental structure.

Figure 2:
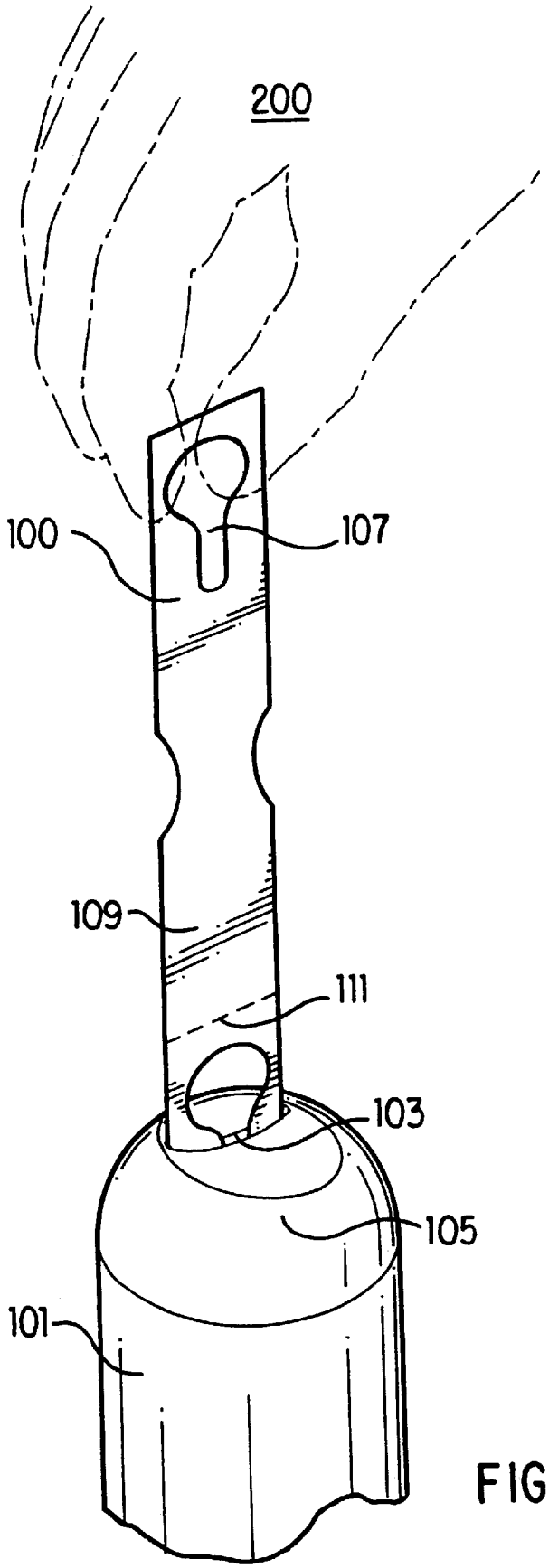
FIG. 2 is a second of three views of a ticket dispensing sequence, showing a user grabbing a tag and pulling upward, according to an embodiment of the present invention.

Turning now to FIG. 2, the hand of a user, shown generally at 200, grippingly engages a proximate end of continuous ticket strip 100, and using a predetermined but not excessive degree of force, pulls in an upward direction while, optionally, grasping the keyhole-like aperture 107 of individual luggage tag 109. Individual luggage tag 109 is now fully exposed, as separable from continuous ticket strip 100 at prescored perforation pattern 111. It is noted that the present invention has been designed to take advantage of a pre-scored perforation pattern which requires a measured, or controlled 'burst' force (see FIG. 9, below) to separate individual luggage tag 109 from continuous ticket strip 100.

According to the instant teachings, this has been accomplished by the elimination of what those skilled in the art know as long or grained fibers which pass through standard perforations. Such fibrous extensions result in rough edges in that there often continue to be minute, and not so minute projections which extend from an area which has been separated. In contradistinction, the teachings of the present invention show a smoothed end finish for each individual luggage tag 109 released from continuous ticket strip 100 at prescored perforation pattern 111.

Figure 3:
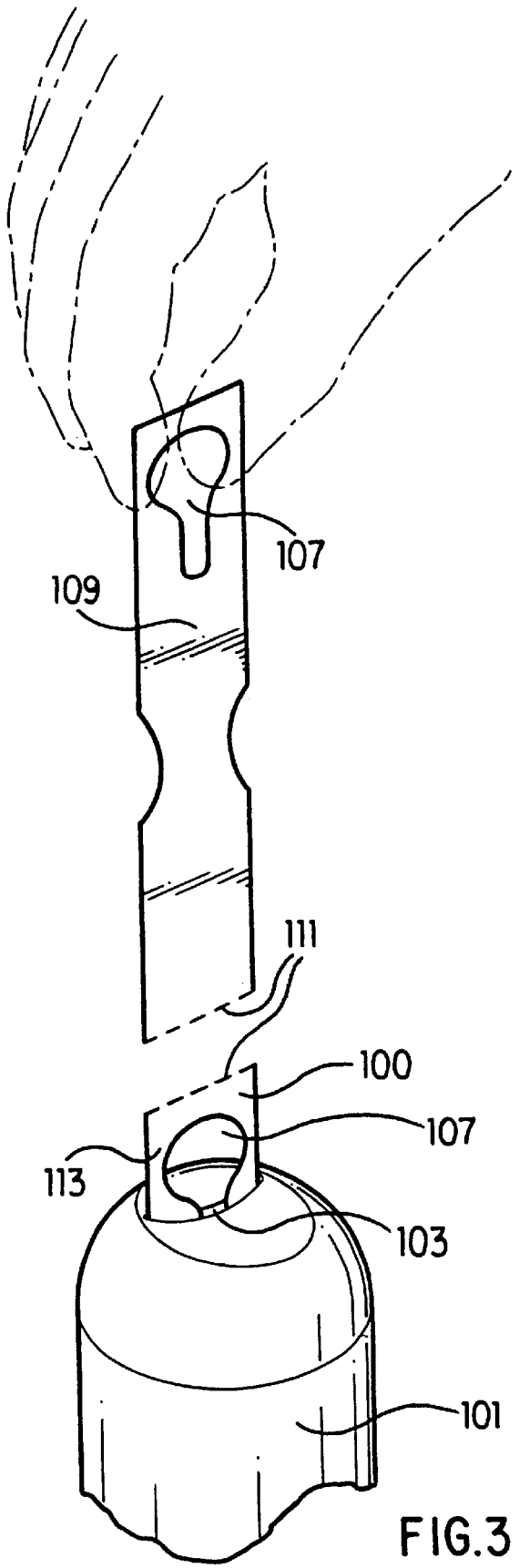
FIG. 3 is a third of three views of a ticket dispensing sequence, showing how the tag is pulled upward until an internal mechanically biased member and a complete interference or ramped spacing mechanism allows for the selective grip and release of objects of the present invention, for example where an internally biased member becomes lockingly engaged within a distal portion of the keyhole shaped aperture of a next linked tag, causing a first tag to snap off, according to an embodiment of the present invention.

Turning now to FIG. 3, individual luggage tag 109 is pulled upward until internal detent mechanism, or the like means, (not shown, discussed below in FIG. 8 and FIG. 10) catches at an end of keyhole-like aperture 107, of subsequent formerly-linked individual luggage tag 113 of continuous ticket strip 100. FIG. 3 shows that breakage occurs at prescored perforation pattern 111, when sufficient pressure is adduced to cause individual luggage tag 109 to become separated from subsequent formerly-linked individual luggage tag 113 of continuous ticket strip 100.

Figure 4:
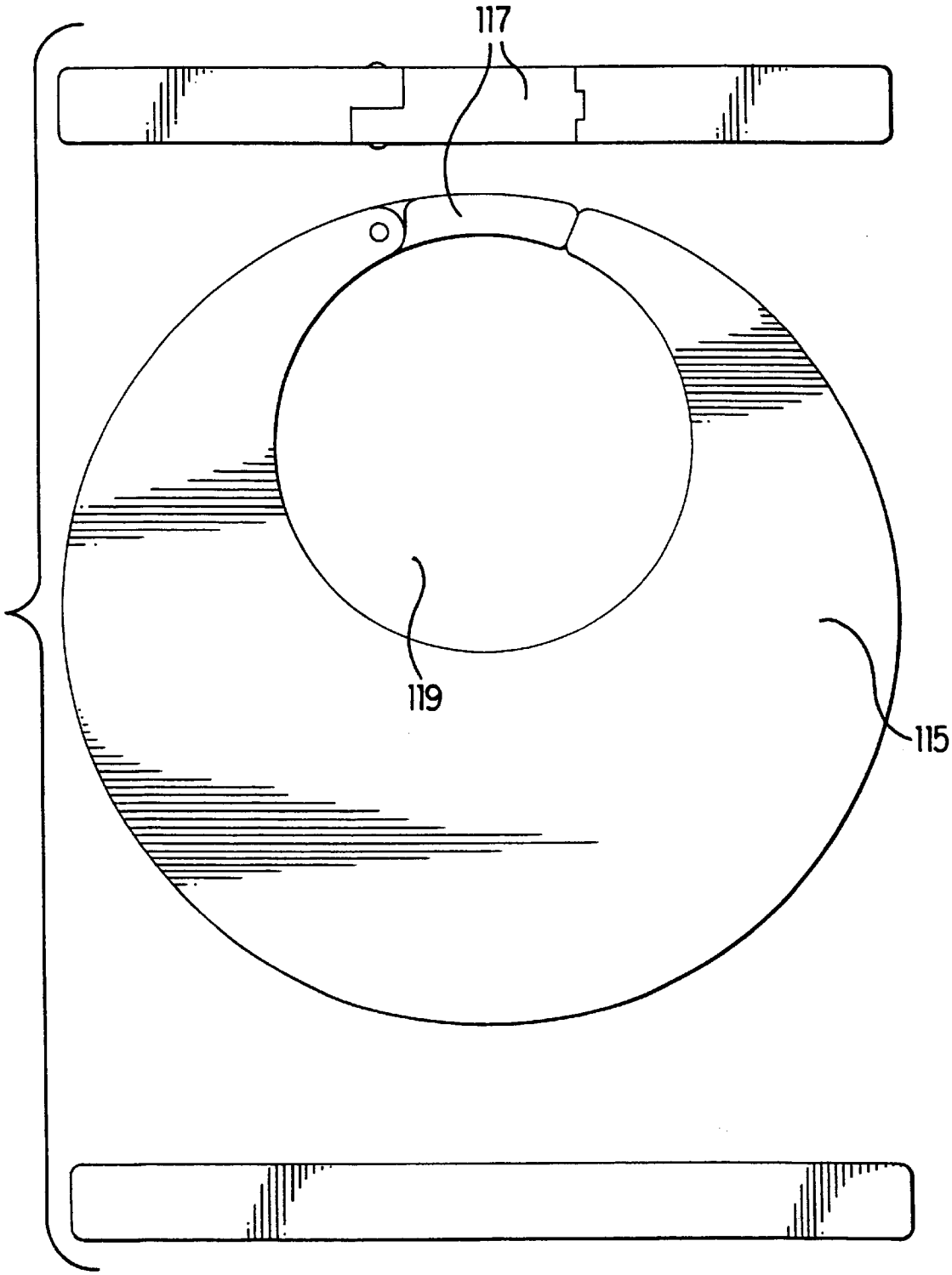
FIG. 4 is a top plan view of an optional writing surface contiguous with a stanchion housing a cartridge, according to an embodiment of the present invention.

Referring now to FIG. 4, one preferred embodiment of contiguous writing surface 115 is shown, having an aperture 119 effective for receiving a second end of stanchion 101 (not shown) at a central portion thereof. The portion of FIG. 4 lying towards the bottom of the page is a view of one side of continuous writing surface 115. Similarly, the portion of FIG. 4 lying towards the top of the page is a view of a second side of continuous writing surface 115. It is within the contemplation of those ordinarily skilled in the art to modify the size, shape and placement of exemplary contiguous writing surface 115, which may likewise be comprised of an available surface of any convenient environmental structure, and be used in association with a writing implement, or the like memory generation or storage medium. Likewise, although not shown in this view, as discussed above and below, a top portion of stanchion 101 through extends through aperture 119 effective for receiving a second end of stanchion 101, having cover 105 with a slotted aperture 103 housing continuous ticket strip 100.

Figure 5:
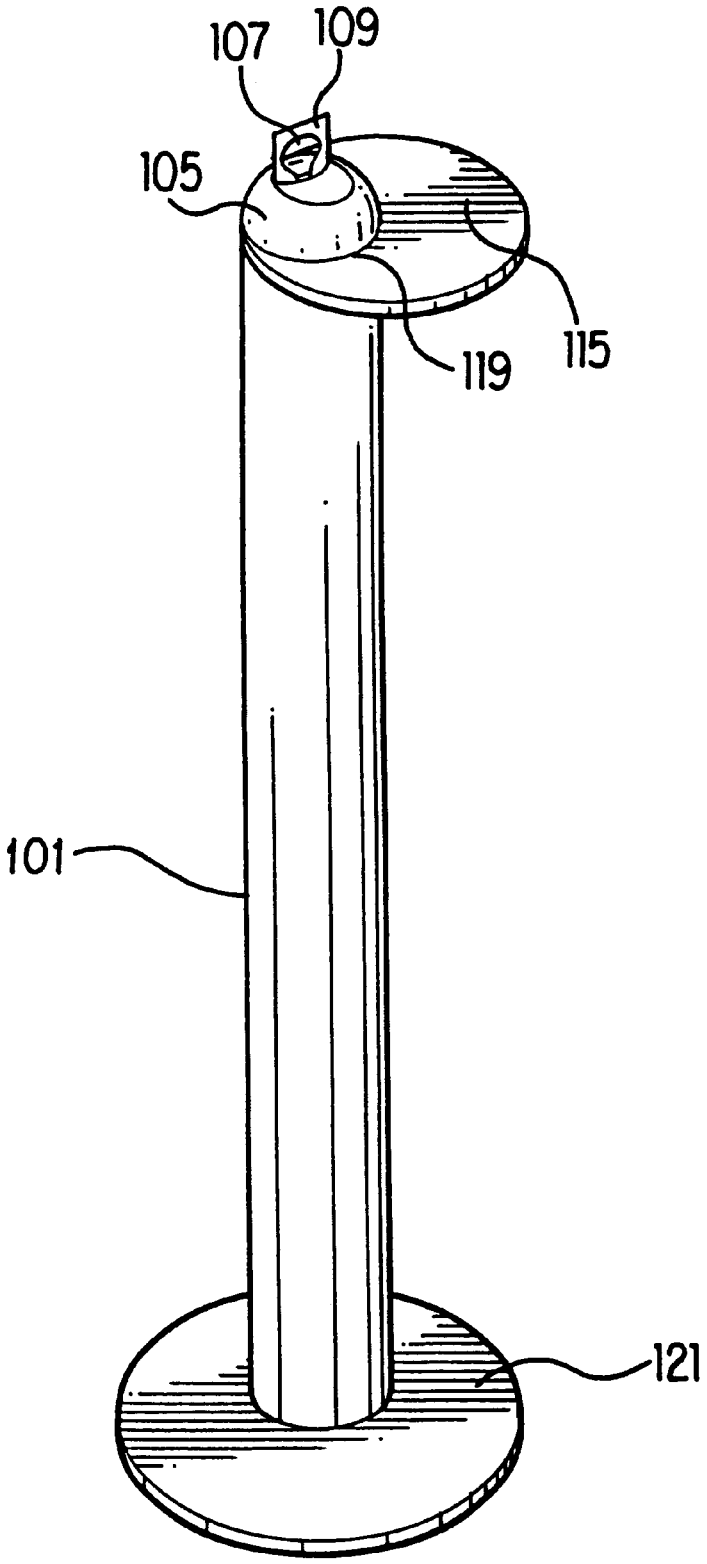
FIG. 5 is a front view of an optional housing mechanism for a preferred embodiment of the instant teachings, namely a stanchion such as typically may be used with, for example a BELTRAC® type system of linked stanchions, incorporating both an optional writing surface and cartridge for dispensing luggage tags according to an embodiment of the present invention.

FIG. 5, shows stanchion 101, which has achieved substantial commercial success as the BELTRAC® public guidance column, along with optional contiguous writing surface 115 shown in a configuration of a preferred embodiment having an aperture 119 effective for receiving a second end of stanchion 101 (not shown) at a central portion thereof. Likewise, although not shown in this view, as discussed above and below, a top portion of stanchion 101 through extends through aperture 119 (filled) effective for receiving a second end of stanchion 101, having cover 105 with a slotted aperture 103 housing individual luggage tag 109, as connected to continuous ticket strip 100. Stanchion 101, at a first end, is fixingly engaged in a central; portion of base 121, such that it has a stable position, and is not easily upended, for example, by children.

Figure 6:
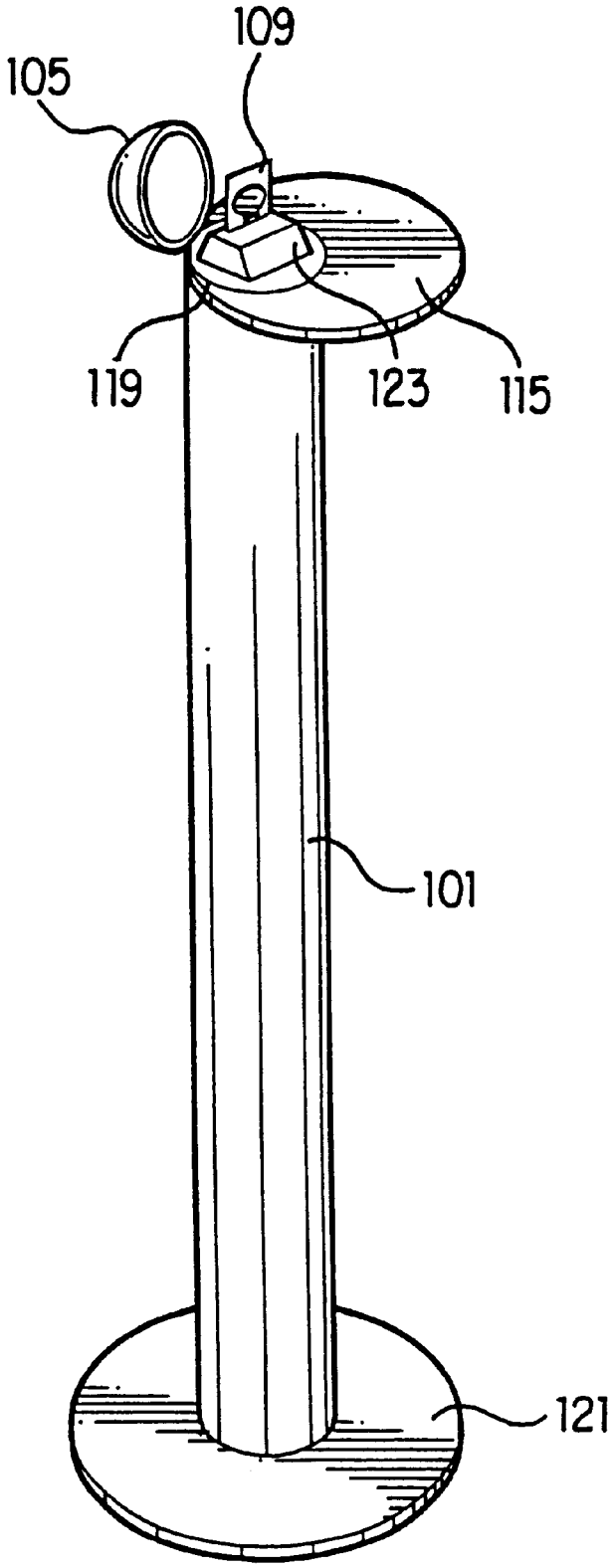
FIG. 6 shows a front view of a stanchion from a BELTRAC® type public guidance column system of linked stanchions, incorporating both a writing surface and cartridge for dispensing luggage tags, with a cover opening to access a ticket ribbon cartridge for reloading according to an embodiment of the present invention.

Turning now to FIG. 6, a frontal view of a typical stanchion 101, which may be used, for example as part of a BELTRAC® public guidance column system of linked stanchions, is shown incorporating both an optional contiguous writing surface 115 and a first end of a cartridge 123 for dispensing luggage tags 109. Said first end of a cartridge is seen extending through aperture effective for receiving stanchion 101 with cover 105, shown in a second, or opened position. Likewise, this mechanism is effective when used with the embodiments shown in FIG. 12, or 14 with slight modifications, such as would be within the skill level of artisans.

Individual luggage tag 109 is shown extending from continuous ticket strip 100. Base 121 supports the entire assembly. Cartridge 123 may be accessed by moving cover 105 from a first, or closed position (as shown in FIG. 5) to a second, or opened position at which time cartridge 123 is drawn out of stanchion 101 for reloading according to an embodiment of the present invention.

Figure 7:
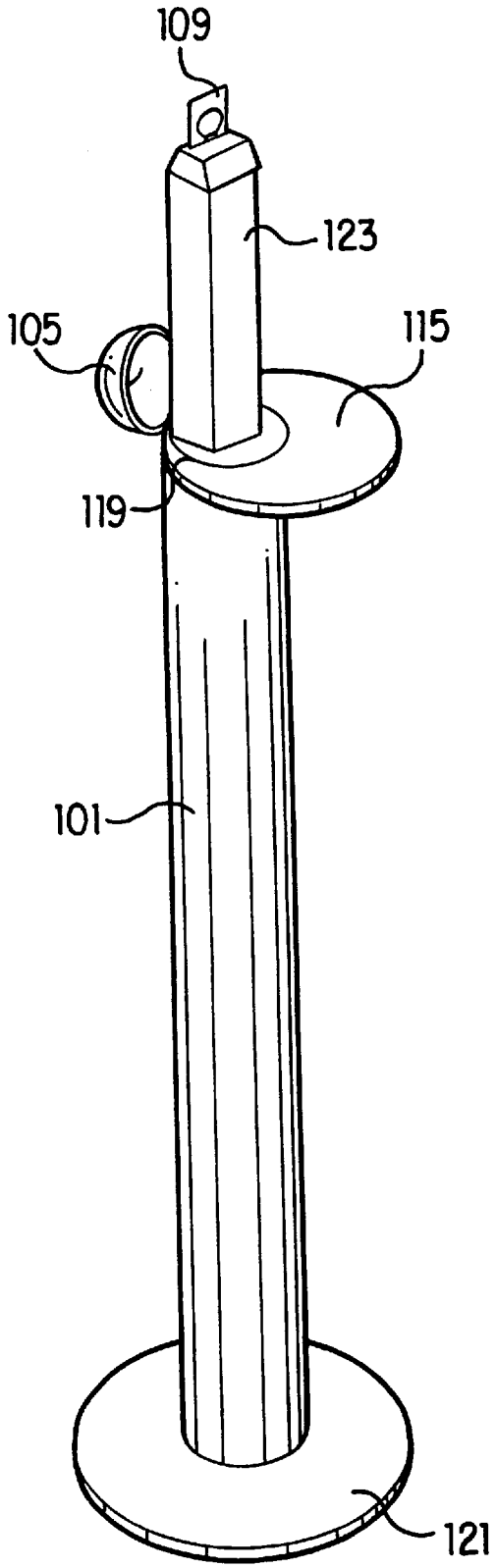
FIG. 7 shows a front view of a stanchion from a BELTRAC® type public guidance column system of linked stanchions, incorporating both a writing surface and cartridge for dispensing luggage tags, with a cover open for accessing a ticket ribbon cartridge, shown here extended in an outward position for reloading according to an embodiment of the present invention.

FIG. 7 shows an additional frontal view of stanchion 101, such as may be used with a BELTRAC® public guidance column system of linked stanchions, or as a freestanding unit, an optional contiguous writing surface 115 and a first end of a cartridge 123 for dispensing luggage tags 109. Said first end of a cartridge is seen extending through aperture stanchion 101 with cover 105, shown in a second, or opened position and cartridge 123 has been drawn out in an outward direction for the purpose of removing cartridge 123 for reloading according to an embodiment of the present invention. A sliding mechanism may be provided to facilitate removal of the cartridge from the stanchion. Those having a modicum of skill in the art understand that the illustrated geometric configuration shown for the cartridge, stanchion and cover are subject to minor modification, adjustment, and variation, such as needed depending on where the instant system is intended to be employed.

Likewise, individual luggage tag 109, as connected to continuous ticket strip 100 (not shown) extends from cartridge 123, housed in stanchion 101, which at a first end, is fixingly engaged in a central portion of base 121, such that it has a stable position, and is not easily upended.

Figure 8:
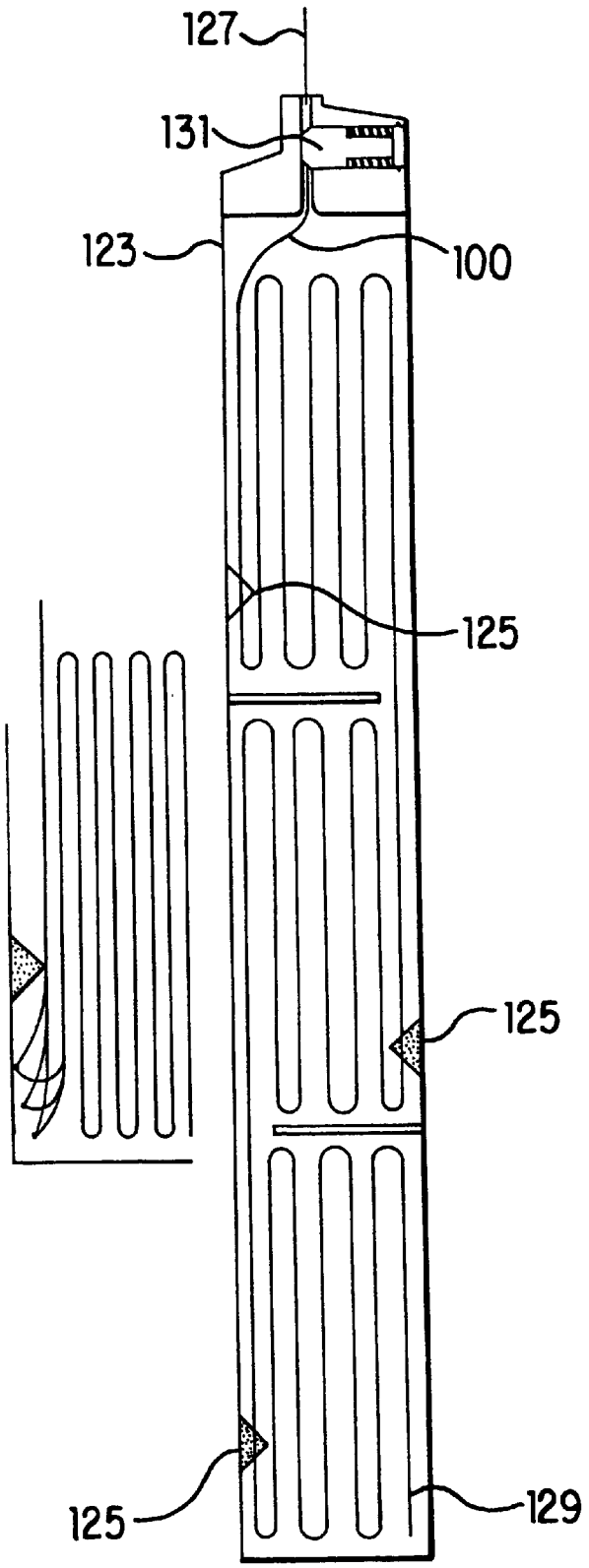
FIG. 8 is a cross sectional view showing the inside of an exemplary version of a cartridge according to the instant teachings, showing at least one of an interference and ramped spacing mechanism useful in combination with a further a detent mechanism and ticket ribbon path effective for holding at least 500 luggage tags for rapid and ready dispensing according to the teachings of an embodiment of the present invention.

Referring now to FIG. 8, a cross sectional view showing the inside of a schematized version of cartridge 123, having ramped spacing mechanism 125 is illustrated in an exemplary fashion. Although the view shown includes three sections internally demarcated within cartridge 123, the present inventor has constructed prototypes having at least one section. Continuous ticket strip 100 consists of a series of individual luggage tags 109, each being bordered by pre-scored perforation patterns 111 (not shown in this view but shown in FIGS. 3, 9 & 10) which enables them to be stacked in a folded arrangement, whereby opposite ends of adjacent ticket-like articles, including individual luggage tags 109 may be stackedly aligned, or pleated as shown in this Figure.

The following mechanism of action is representative, and not limiting of the embodiments operationalized according to the instant teachings. It is further noted that the detent mechanism comprising a biased means for selectively extending a piston-like member is implemented by at least one of springs, spring loaded plastics, rubberized coils, and a plurality of the like materials which can be subjected to tension and released.

Thus, according to the illustrated embodiment, by pulling proximate end 127 of continuous ticket strip 100, the stacked, pleated arrangement of continuous ticket strip 100 unfolds, and each individual luggage tag 109 moves forward from distal end 129 in the direction of internal detent mechanism 131.

According to a preferred embodiment, cartridge 123 has a ticket ribbon path effective for holding, in this instance, approximately 500 luggage tags. Ramped spacing mechanism 125 acts a spacer in cartridge 123, providing room for continuous ticket strip 100 to turn as it is drawn from distal end 129 toward a preferred embodiment of internal detent mechanism 131, as explained further below.

Figure 9:
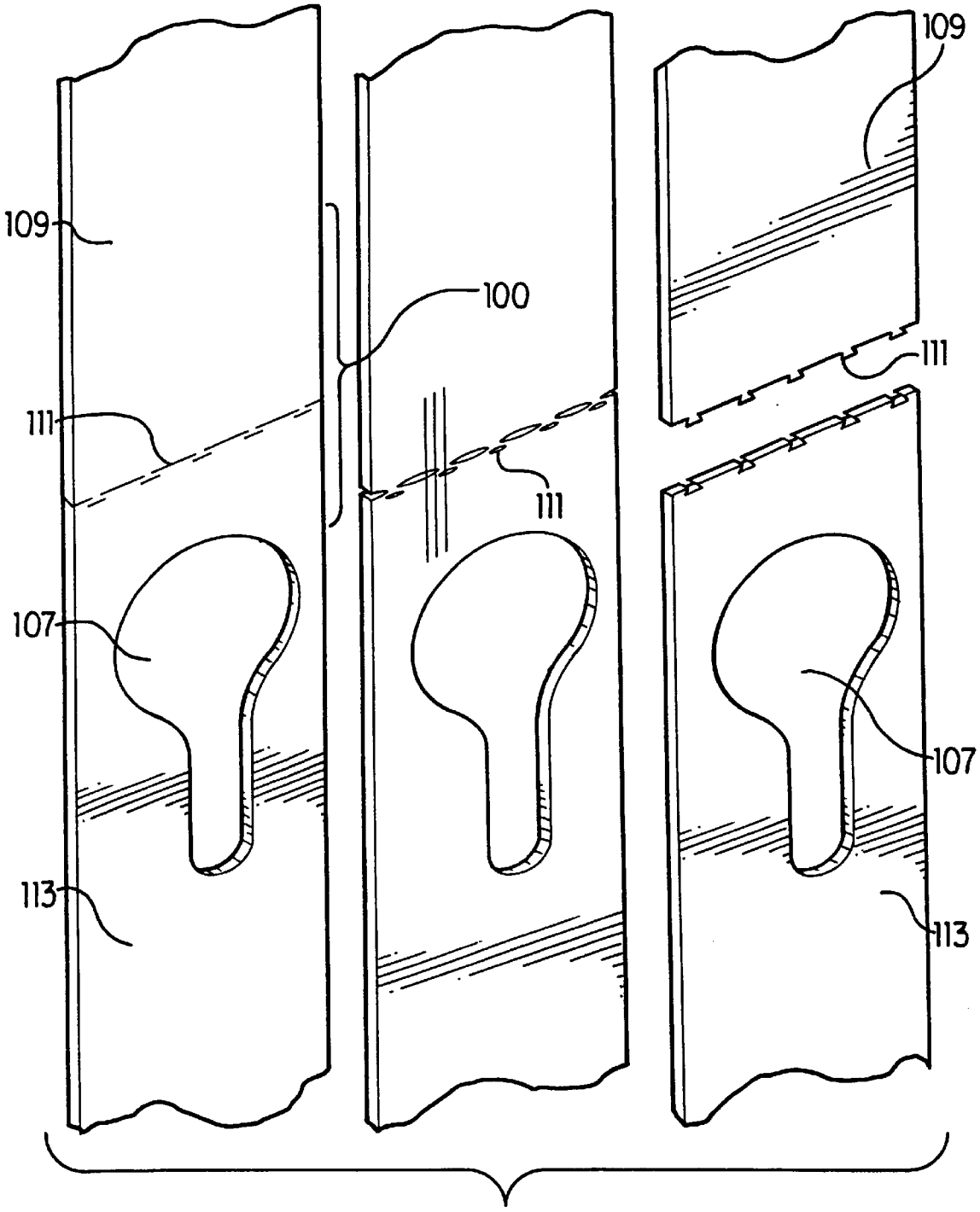
FIG. 9 is a schematic illustration showing alternate patterns of overlapping scores or incisions, an illustrated set of preferred embodiments having at least two rows of perforation patterns used with a strip of continuous tickets according to an embodiment of the present invention.

Referring now to FIG. 9, a schematic illustration showing applicant's novel perforation patterns 111, as used according to this preferred embodiment with a strip of continuous tickets according to the present invention, is offered for consideration. FIG. 9 is divided into three sequential segments, whereby the first view shows breakage requires the appropriate tension level as exercised by the force of a users drawing the proximate end of continuous ticket strip 100 in an upward direction. The second view shows how each of the two separate lines of perforations pull apart. The actual separation occurs at prescored perforation pattern 111, when sufficient pressure is adduced to cause individual luggage tag 109 to become separated from subsequent formerly-linked individual luggage tag 113 of continuous ticket strip 100. It is noted that an alternate preferred embodiment appears in the third view, where the two separate lines of perforations have been replaced by a set of "lock and key" fitting teeth and receptacles for the same.

Figure 10:
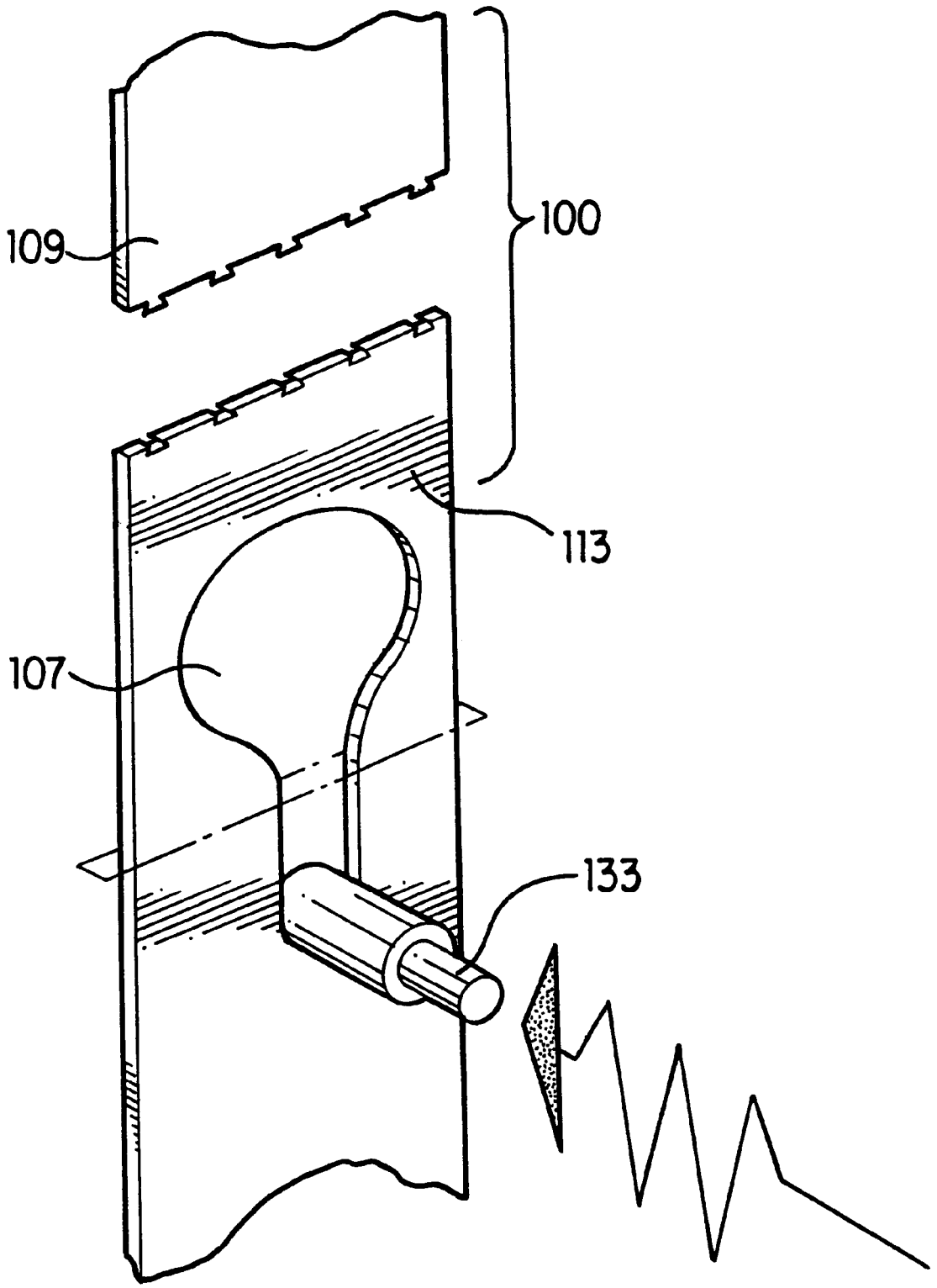
FIG. 10 is a schematic of an embodiment of a mechanically biased member, as shown herein, a piston-means used to selectively grip first one, then a next individual ticket article within a strip of continuous tickets, as shown in FIG. 9, illustrating the sliding of a preferred embodiment of a mechanically biased member, including a spring loaded piston-means over the ticket while dispensing and then dropping into the keyhole-like aperture of the next linked ticket acting like a detent and causing the dispensing tag to snap off.

FIG. 10 completes the schematic illustration of a preferred embodiment of internal detent mechanism 131 (FIG. 9) including, for example, in this view a spring biased piston means 133. According to the figure, strip of continuous tickets 100 are pulled by a user with force such that the sliding of individual luggage tag 109 over piston means 133 is biased keeping piston means 133 in a first, or recessed position while dispensing. Once piston means 133 slides to a position where it may become unbiased by extending into keyhole-like aperture 107, this provides force required to hold subsequent individual luggage tag 113, while individual luggage tag 109 is released.

Likewise, alternate preferred embodiments feature related mechanisms, including any appropriate material capable of repeatedly being biased and releasing tension, as shown with the spring loaded piston means 133 shown in FIG. 10. Those skilled in the art will readily ascertain the equivalent structures effective for implementing the instant detent mechanism, wherein the force required to overcome the detent is slightly higher than the force required to burst a prescored perforation 111, according to embodiments of the instant teachings.

By sliding into or dropping into the keyhole-like aperture 107 of the next linked ticket 113 acting like a detent, piston means 133 causes the dispensing tag 109 to snap off. Similarly, the present invention contemplates related ways of separating tickets, tags, label and the like means for identifying luggage, and other things.

Figure 11:
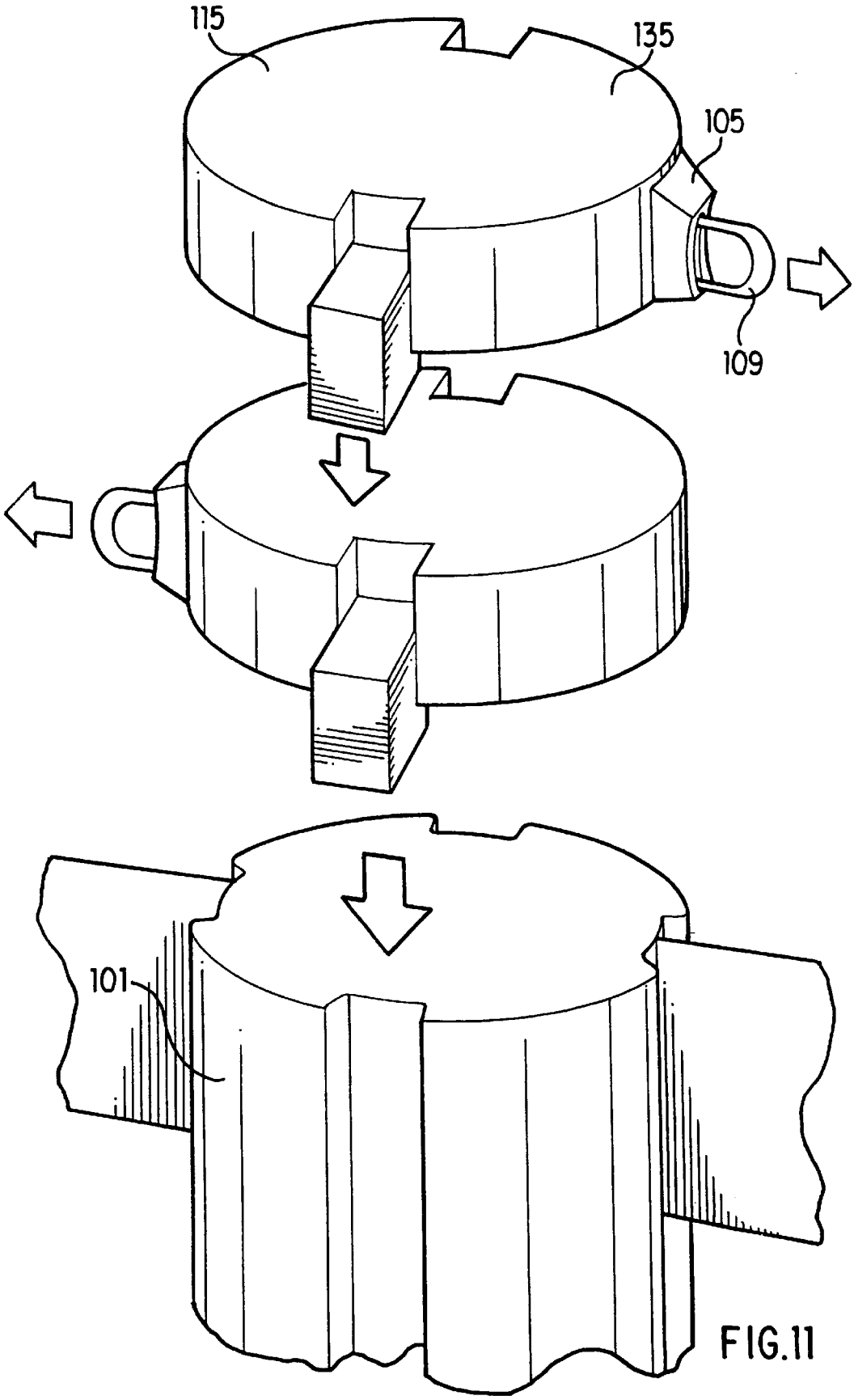
FIG. 11 is an illustration of an alternate, or stackable embodiment according to the teachings of the present invention.

Turning now to FIG. 11 an illustration of an alternate, or stackable embodiment 135 according to the teachings of the present invention is shown. In this view, it can be seen that continuous ticket strip 100 has been configured in a 'rolled' arrangement, as opposed to the 'stacked' configuration shown in the prior figures.

According to this alternate preferred embodiment cover 105 releases individual luggage tag 109 in the direction indicated by the arrow, and writing surface 115 is a disposed above stanchion 101, which is grooved or slotted as is known with the BELTRAC® public guidance column system of linked stanchions, shown in this view.

Figure 12:
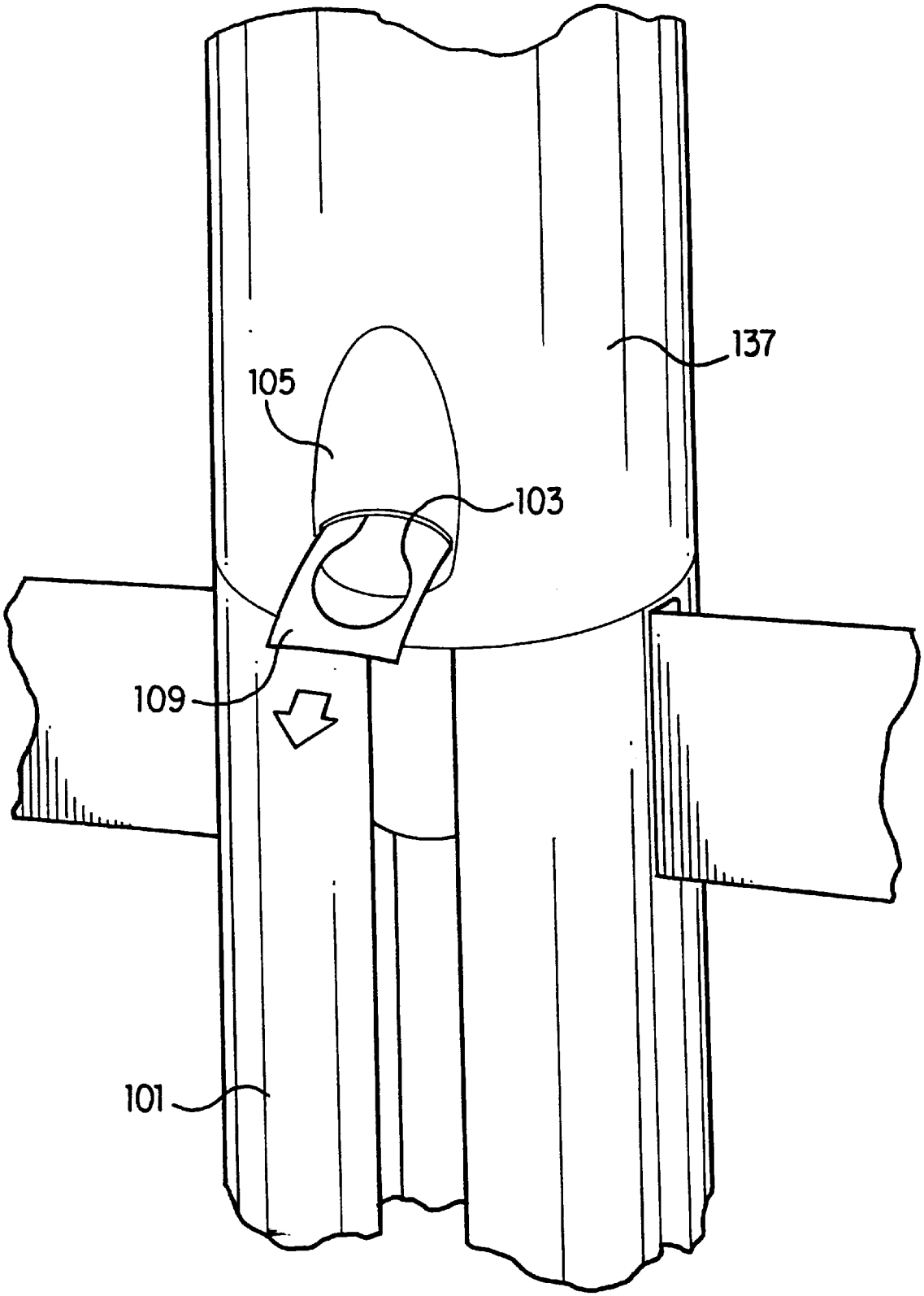
FIG. 12 is an illustration of an alternate, gravity-fed dispenser embodiment according to the teachings of the present invention.

FIG. 12 is an illustration of yet another alternate, additional embodiment for a gravity-fed dispenser 137 according to the teachings of the present invention. Likewise, with this alternate preferred embodiment cover 105 releases, for example, individual luggage tag 109 through slotted aperture 103. Stanchion 101 employs related mechanism to receive gravity-fed dispenser 137, and maintain the same in a secure position.

Figure 13:
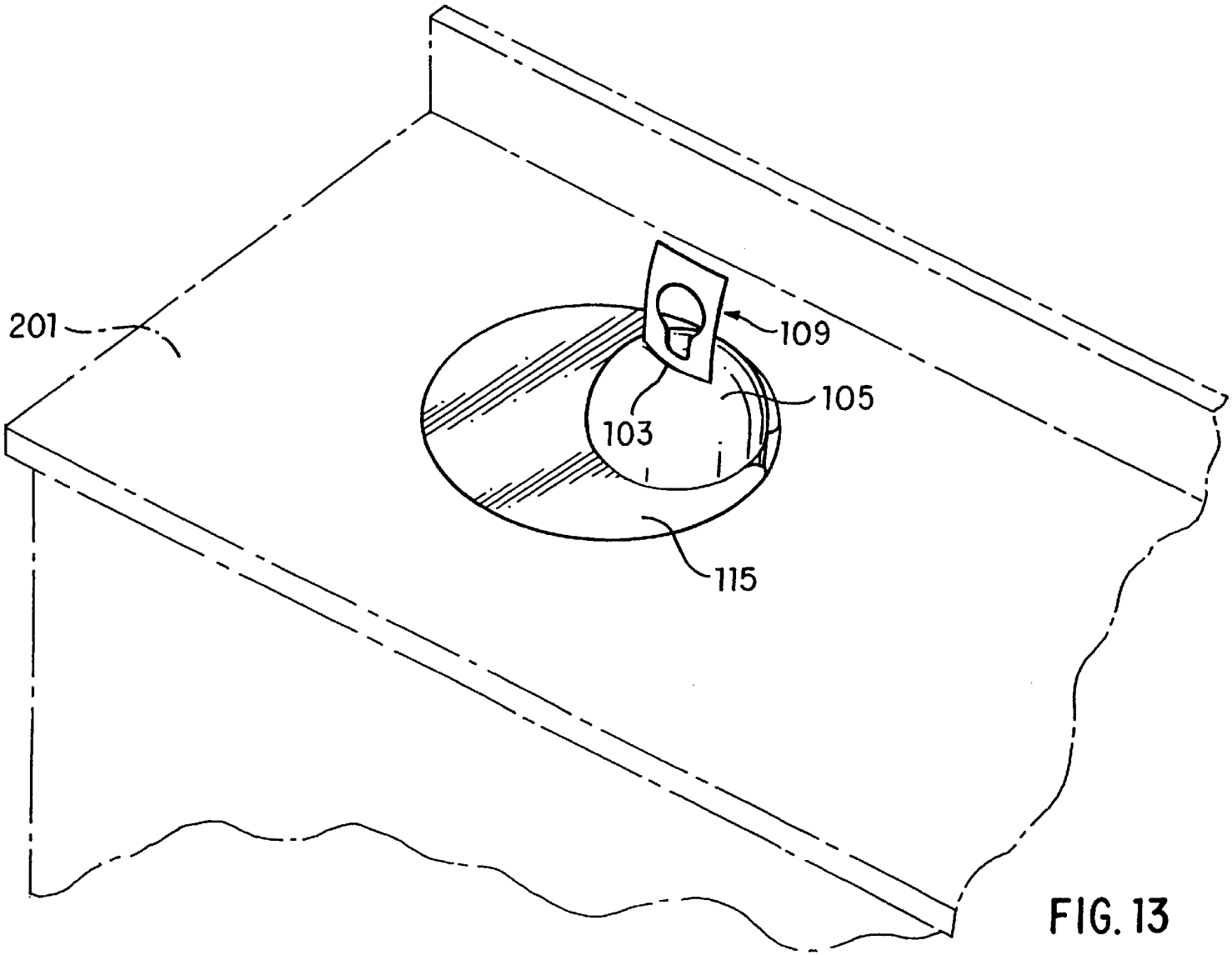
FIG. 13 shows an alternate preferred embodiment, wherein a ticket dispensing mechanism is embedded in the counter, at for example, an airport.

FIG. 13 shows an alternate preferred embodiment, wherein a ticket dispensing mechanism is embedded in the counter, at for example, an airport. Likewise, with this alternate preferred embodiment cover 105 release individual luggage tag 109 through slotted aperture 103. Counter 201 houses either cartridge 123, roll 135 or related dispensing apparatus 138, and maintains the same in a secure position.

Figure 14:
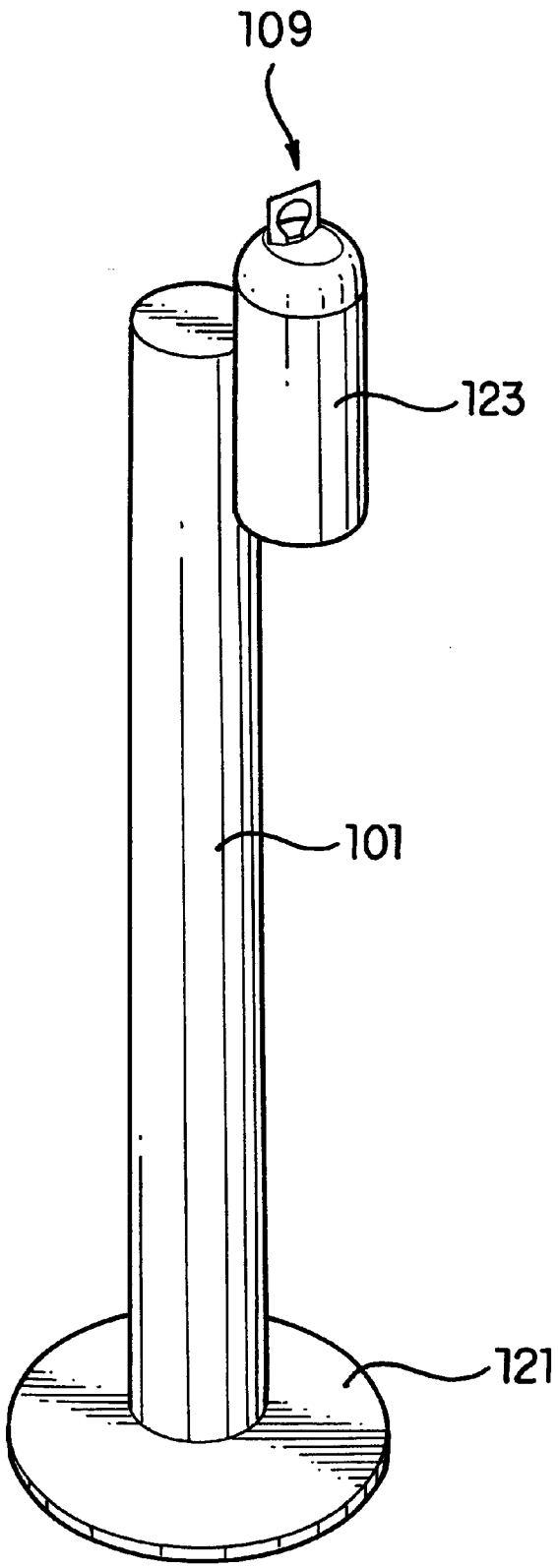
FIGS. 14 and 15 show alternate preferred embodiments, wherein the cartridge placed in a position adjacent to, and on top of the stanchion.
Figure 15:
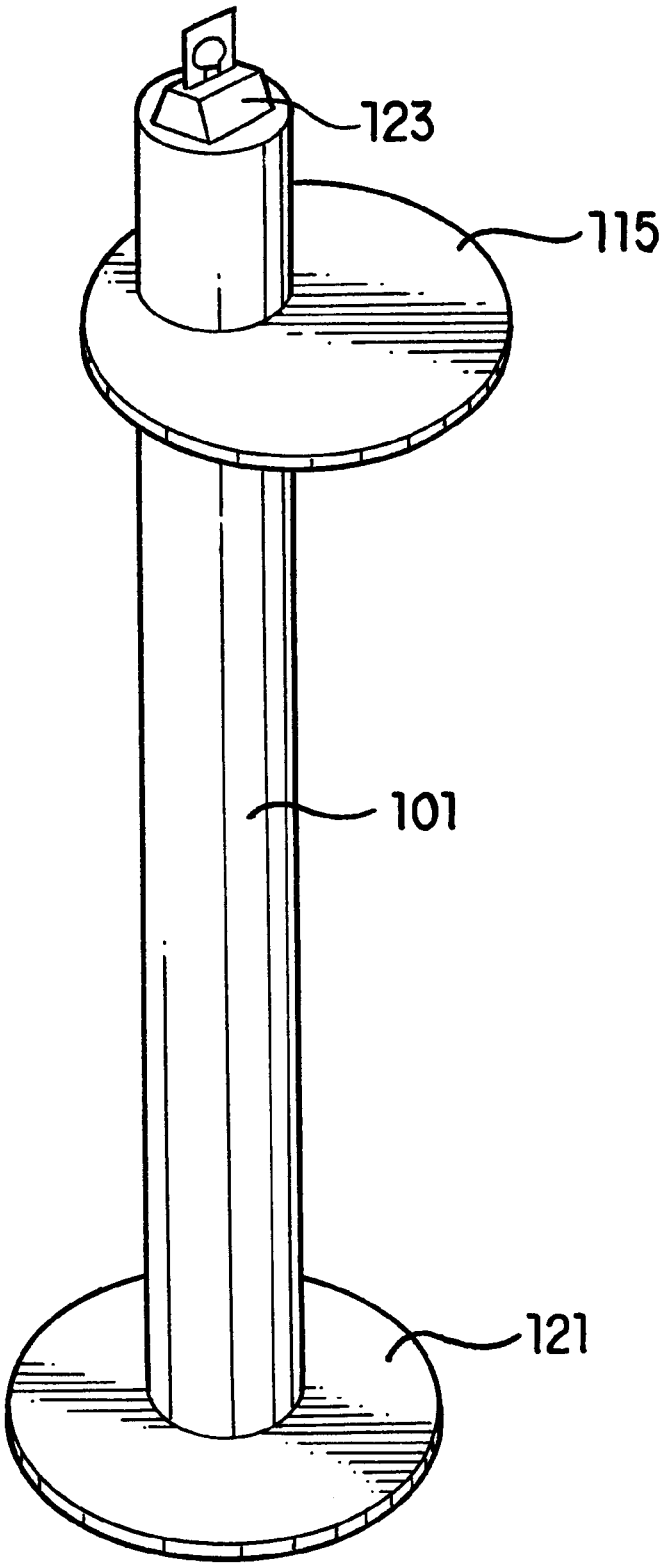

FIGS. 14 and 15 show alternate preferred embodiments, wherein the cartridge placed in a position adjacent to, and on top of the stanchion.

Having described preferred embodiments of the invention with reference to the accompanying drawings, it is to be understood that the invention is not limited to those precise embodiments, and that various changes and modifications mat be effected therein by one of skill in the art without departing from the scope or spirit of the invention as defined in the appended claims.

What is claimed is:

1. A dispensing system for luggage tags, comprising:

a moveable, vertically extending, generally tubular stanchion having a first end and a second end, wherein said stanchion includes means for joining a plurality of stanchions to form a system of joined stanchions;

a cartridge which is removeably engaged with said stanchion and configured to retain luggage tags, wherein said cartridge is located adjacent to the first end of said stanchion;

a plurality of luggage tags housed in said cartridge;

a detent mechanism joined to said stanchion for selectively engaging each of said plurality of luggage tags so that said tags are dispensed one at a time; and a base located at said second end of said stanchion.

2. A ticket dispensing system as defined in claim 1, further including a writing surface located adjacent to the first end of said stanchion.

3. The ticket dispensing system as defined in claim 2, wherein the writing surface is substantially horizontal.

4. A ticket dispensing system as defined in claim 1, wherein the cartridge is placed in a position selected from the group consisting of: disposed within, on top of, and substantially adjacent to said stanchion.

5. The ticket dispensing system defined in claim 1, wherein the ticket dispensing system further comprises:

a cover adjacent to the cartridge, wherein the cover is capable of being moved from a first, closed, to a second, opened position; and, a sliding mechanism, whereby the sliding mechanism engages the cartridge, and further whereby the cartridge moves along the sliding mechanism as the cartridge is removed from the stanchion.

6. The ticket dispensing system defined in claim 1, said multiplicity of luggage tags further comprising a continuous strip of luggage tags individuated into separately defined tags by at least one distinct line of marks displaced on the strip at a selected location, wherein the marks are selected from the group consisting of scores, incisions, perforations and a combination thereof.

7. The ticket dispensing system defined in claim 1, said multiplicity of luggage tags further comprising a continuous strip of tags having a beginning and a terminal end, whereby the terminal end of said strip is identified by color.

* * * * *